US006268699B1

(12) United States Patent
Woodward et al.

(10) Patent No.: US 6,268,699 B1
(45) Date of Patent: Jul. 31, 2001

(54) ELECTRODELESS GAS DISCHARGE LAMP ASSEMBLY HAVING TRANSVERSELY MOUNTED ENVELOPE AND METHOD OF MANUFACTURE

(75) Inventors: Ronald O. Woodward, Yorktown, VA (US); Jack D. Bodem, Kokomo; Robert L. Kohne, Noblesville, both of IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/247,732

(22) Filed: Feb. 9, 1999

(51) Int. Cl.[7] ..... H01J 17/16; H01J 61/30; H01J 1/50; H01J 23/10; H01J 29/76

(52) U.S. Cl. ..... 313/634; 313/160; 313/161; 313/607; 313/234; 313/493; 362/263; 362/265; 362/310; 315/248; 315/39; 445/23

(58) Field of Search ..... 313/156–57, 160, 313/161, 493, 607, 234, 631, 634–35; 315/248, 39, 44; 362/263, 265, 310; 445/23

(56) References Cited

U.S. PATENT DOCUMENTS

| | | | | |
|---|---|---|---|---|
| 1,816,619 | | 7/1931 | Smith . | |
| 2,102,189 | | 12/1937 | Barclay . | |
| 2,776,391 | | 1/1957 | Peek, Jr. et al. . | |
| 2,966,601 | | 12/1960 | Peek, Jr. . | |
| 3,636,396 | | 1/1972 | Gruzdev et al. . | |
| 4,206,387 | | 6/1980 | Kramer et al. . | |
| 4,894,591 | * | 1/1990 | Witting | 315/248 |
| 5,028,847 | | 7/1991 | Greb et al. | 315/248 |
| 5,065,075 | | 11/1991 | Greb | 315/248 |
| 5,072,157 | | 12/1991 | Greb et al. | 315/248 |
| 5,086,258 | | 2/1992 | Mucklejohn et al. | 315/248 |
| 5,111,117 | | 5/1992 | Greb et al. | 315/248 |
| 5,349,271 | | 9/1994 | van Os et al. . | |
| 5,367,226 | * | 11/1994 | Ukegawa et al. | 315/248 |
| 5,747,945 | * | 5/1998 | Ukegawa et al. | 315/248 |
| 5,852,339 | * | 12/1998 | Hamilton et al. | 313/607 X |
| 5,998,914 | * | 12/1999 | Kohne et al. | 313/607 X |

* cited by examiner

*Primary Examiner*—Nimeshkumar D. Patel
*Assistant Examiner*—Mack Haynes
(74) *Attorney, Agent, or Firm*—Reising, Ethington, Barnes, Kisselle, Learman & McCulloch, P.C.

(57) ABSTRACT

An electrodeless gas discharge lamp includes a light-transmissive envelope having opposite ends and a midsection about which an induction coil is disposed. The envelope and coil are mounted transversely on a base with the ends of the envelope exposed such that light emitted from the envelope is transmitted through both ends of the envelope substantially unobstructed by either the base or coil to generate a high total light output of the assembly.

21 Claims, 3 Drawing Sheets

ELECTRODELESS GAS DISCHARGE LAMP ASSEMBLY HAVING TRANSVERSELY MOUNTED ENVELOPE AND METHOD OF MANUFACTURE

BACKGROUND OF THE INVENTION

1. Technical Field

This invention relates generally to electrodeless gas discharge lamps and more particularly to the configuration and arrangement of the envelope in which the discharge gas is sealed relative to the surrounding induction coil and mounting base.

2. Related Prior Art

Various configurations and arrangements of the induction coil and envelope of electrodeless gas discharge lamps are known. The simplest in form comprises an oblong envelope having opposite axial ends and a midsection about which the coil is wrapped. One end of the envelope is mounted in a socket of a lamp base and the other end is free and unobstructed. The blockage of the midsection and mounted end of the envelope by the coil and base restricts the light output of the lamp.

Attempts to overcome the blockage problems often involve the provision of an envelope of complex shape, for example bell-shaped envelope having an interior cavity in which the coil is disposed. However, such complications add to the cost and complexity of manufacturing such light sources.

It would be desirable to provide an electrodeless gas discharge lighting assembly having an envelope, coil and base of simple construction configured and arranged in a way that minimizes obstruction of the envelope by either the coil or base in order to increase the total light output of the assembly.

SUMMARY OF THE INVENTION AND ADVANTAGES

An electrodeless gas discharge lamp assembly constructed according to the present invention comprises a light-transmissive envelope having opposite ends and a mid-section between the ends with an ionizable gas sealed therein. An induction coil is disposed about the midsection in substantially unobstructing relation to the ends of the envelope and is operative to excite the gas within the envelope to discharge illumination. The envelope and coil are mounted transversely on a lamp base with the opposite ends of the envelope exposed such that light emitting from the envelope is transmitted out of both ends of the envelope substantially unobstructed by the coil and base.

By constructing and arranging the components in such a way that the ends of the envelope are not blocked substantially by either the coil or the base, the total light output is increased in comparison to lamps in which only one end is exposed. The double-ended envelope effectively provides two light sources at the opposite ends of the envelope as opposed to just one. In an application where the light assembly includes a reflective housing for redirecting rearwardly transmitted light rays forwardly, the greater light output of the double ended envelope correspondingly increases the total light output of the lamp assembly.

In other applications where light is required to be directed in different directions, such as double-sided beacon-type flashers commonly used on road construction barriers, pylons, signage, and the like, the double-ended light assembly of the invention can be employed as a single source supply of oppositely directed light.

The invention also provides a method of making electrodeless gas discharge light assemblies and includes disposing an induction coil about the midsection of a gas discharge envelope without substantially obstructing opposite ends of the envelope and mounting the coil and envelope transversely on a lamp base with the ends of the envelope exposed such that light emitting from the envelope is transmitted out of both ends of the envelope substantially unobstructed by the coil and base.

BRIEF DESCRIPTION OF THE DRAWINGS

These and other features and advantages of the present invention will become more readily appreciated when considered in connection with the following detailed description and appended drawings, wherein.

DETAILED DESCRIPTION

Figure 1:
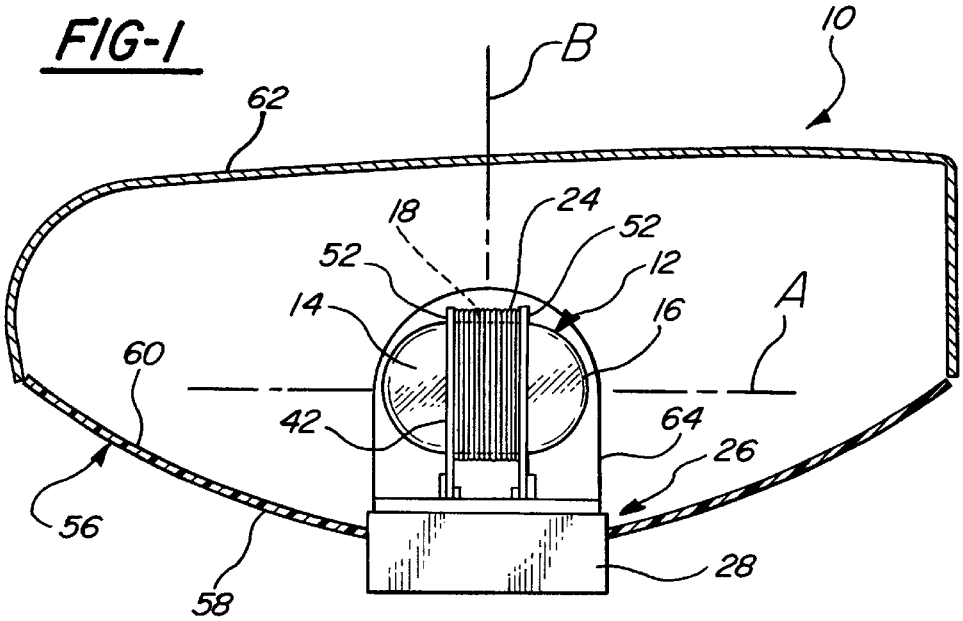
FIG. 1 is a schematic elevation view, shown partly in section, of a light assembly constructed according to a first presently preferred embodiment of the invention.
Figure 2:
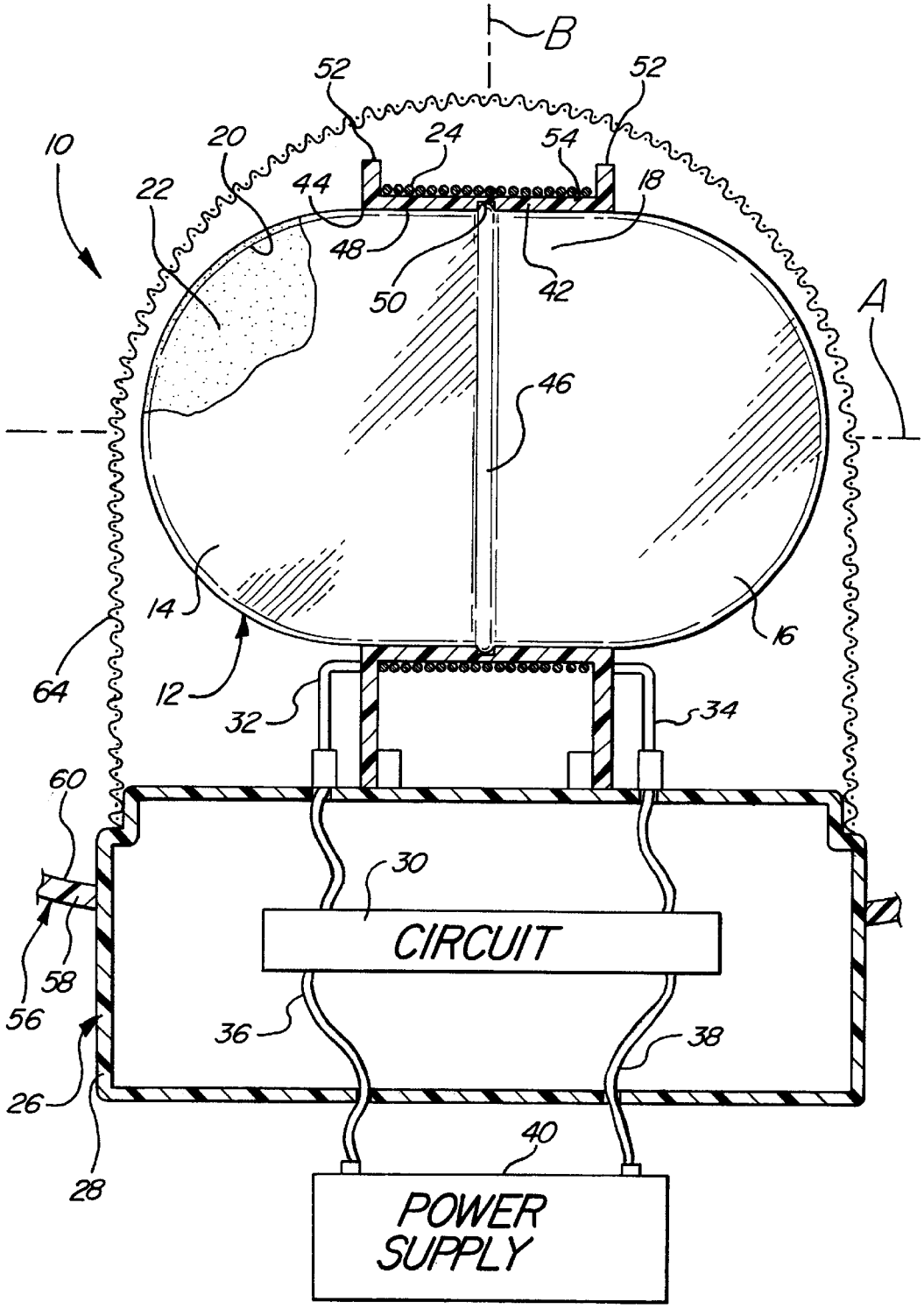
FIG. 2 is an enlarged schematic fragmentary plan view of the lamp assembly of FIG. 1 shown partly in section.

An electrodeless gas discharge lamp assembly constructed according to a first presently preferred embodiment of the invention is indicated generally at 10 in FIGS. 1 and 2 and comprises a light-transmissive envelope 12 having opposite ends 14, 16 and a midsection 18 between the ends 14, 16. The ends 14, 16 are preferably axially opposed to one another such that they face in opposite axial directions. As shown best in FIG. 2, the envelope 12 is preferably elongated in the axial direction A of the envelope between the ends 14, 16 and preferably has a generally oblong, capsule shape. The end portions 14, 16 are preferably convex in shape and bulge axially outwardly of the midsection 18, which is generally cylindrical in configuration. The envelope 12 defines an enclosed space 20 in which an ionizable gas 22 is sealed and excitable to discharge illumination. Any of a number of ionizable gases suitable for electrodeless gas discharge lighting applications may be employed, including, for example, neon, xenon, mercury, mixtures of these and/or others.

The light-transmissive envelope 12 may be fabricated of any of a number of light-transmissive, gas-impervious materials including those commonly used in gas-discharge lamp applications, such as quartz, sodium glass or the like.

The assembly 10 further includes an induction coil 24 that is disposed about the midsection 18 of the envelope 12 in operative relation to the envelope so as to induce the gas 22 to discharge illumination upon energization of the coil 24.

The envelope 12 and coil 24 are mounted on a lamp base 26, with the envelope 12 supported transversely such that the opposite ends 14, 16 of the envelope 12 are exposed and substantially unencumbered by either the coil 24 or base 26, permitting light emitting from the envelope 12 to be transmitted out of both ends 14, 16 of the envelope substantially without obstruction from the coil 24 or base 26.

As shown in FIGS. 1 and 2, the base 26 has an axis B extending in the direction of the envelope 12. The axis A of the envelope 12 is transverse and, in the preferred embodiment, is preferably perpendicular to the axis B to define the transverse relationship between the envelope 12 and base 26.

The base 26 has a main body portion 28 which houses a suitable circuit 30 coupled by leads 32, 34 operatively to the induction coil 24, and in turn by leads 36, 38 to a power supply 40, which may be a battery or a generator such as that of an automotive electrical supply system of a vehicle.

The base 26 further includes a mounting collar or bobbin 42 projecting axially outwardly of the main body portion 28 defining an internal opening or through-socket extending transversely of the axis B in which the envelope 12 is disposed. The collar 42 preferably is in the form of an annular ring whose opening 44 is of a size that enables the envelope 12 to be inserted into the collar 42 from one end and extended through the opening 44 until the collar 42 is positioned about the midsection 18 of the envelope 12, as illustrated. The ends 14, 16 of the envelope 12 extend axially beyond the collar 42 and are thus free from obstruction by the collar 42.

The midsection 18 of the envelope 12 is preferably formed with a locking projection 46 that may comprise a radially enlarged annular ring or protrusion having a diameter relatively larger than that of the inner wall 48 of the opening 44. The inner wall 48 is formed with a complimentary locking recess in the preferred form of an annular groove 50 sized to receive and retain the locking projection 46 of the envelope within the mounting collar 42 to define a mechanical interlock therebetween. In practice, the locking projection 46 is slightly larger in size than that of the inner wall 48 so as to enable the envelope 12 to be forcibly inserted into the collar 42 via yielding of the collar material 42 until such point as the projection 46 is received in the locking groove 50, at which point the material of the collar 42 returns radially inwardly regaining its original shape and size to retain the envelope 12. Thus, it is preferred that the collar 42 be fabricated of a material that is sufficiently resilient to accommodate the passage of the projection 46 without breaking either the collar 42 or envelope 12, and with sufficient rigidity to retain the envelope 12 within the collar 42 following installation. A suitable cement or adhesive may additionally or alternatively be employed to secure the envelope 12 in the collar 42. Suitable organic polymeric materials, such as a glass filled nylon or the like, would suffice for the collar material. The material of the mounting collar 42 further is transparent or nearly transparent to high frequency signals generated by the induction coil 24 so as not to interfere with the ability of the coil 24 to excite the gas 22 to discharge illumination, which will be described presently.

As mentioned, the coil 24 is disposed about the midsection 18 of the envelope 12. In the preferred embodiment, the collar 42 which mounts the envelope 12 transversely of the base 26 is also used to mount the coil 24. The outer diameter of the collar 42 serves as a spool about which the coil 24 is wrapped in a tight helical wind, as illustrated. To confine the coil 24 axially within the midsection 18 and retain it from extending to the opposite ends 14, 16 in a way that would substantially obstruct the emission of light from the ends 14, 16, the collar 42 is provided with radially outwardly projecting end flanges 52 which, together with the outer diameter surface 54 of the collar 42, define an external annular channel in which the coil 24 is disposed and contained.

According to the first embodiment, the envelope 12, coil 24 and base 26 define a self-contained light module which may serve as a light source and be installed in a light housing 56 of the assembly 10 which may comprise, for example, a light housing of a vehicular taillight, signal light, marker, or the like. The housing 56 has a back wall 58 and a concave reflective surface 60 disposed about the axis B of the base 26. The reflective surface 60 may comprise the interior surface of the back wall 58 or may comprise a separate reflector component, as known in the art. Any suitable means may be used to mount the lighting module on the housing 56 and may include, for example, twist-lock, snap-in, slide lock, lock rings, etc. which would operate to secure the light module to the housing 56 and support the envelope 12 in forwardly spaced relation to the reflective surface 60 along the axis B of the base with the ends 14, 16 of the envelope 12 exposed and at least partially facing the reflective surface 60 unobstructed by the coil 24 or base 26 as illustrated in FIG. 1.

The reflective surface 60 diverges outwardly to an open end thereof which is closed by a light-transmitting lens cover 62. The lens 62 preferably is manufactured to include a light-defusing pattern or features provided across the surface thereof conventionally used for defusing light transmitted through the lens 62 in a predetermined manner to achieve the desired lighting characteristics which are know per se in the lighting art.

In operation, the induction coil 24 receives power from the power supply 40 and circuit 30. The circuit 30 is operative to convert the output of power supply 40 to cause the induction coil 24 to emit high frequency energy signals which act on the gas 22 to ionize and excite the gas to discharge illumination. It is preferred that the circuit 30 and coil 24 operate in the RF range, such that the coil 24 emits RF signals to drive the gas 22. The principals of discharge illumination through high frequency induction signals are well known to those in the art, along with the circuitry for generating such signals, and thus will not be addressed further here.

In order to contain the RF signals within the assembly, a high frequency shield, or RF shield 64 is disposed about the envelope 12 and induction coil 24 and preferably is unified with the base 26. The RF shield 64 may comprise a dome-shaped screen as shown capping the envelope 12 and fixed at its lower end to the base 26. The main body portion 28 of the base 26 may be further provided as necessary with suitable shielding to prevent any high frequency signals from escaping the base 26.

As the gas 22 within the envelope 12 is excited to discharge illumination, the light which is generated is able to escape both ends 14, 16 of the envelope substantially without obstruction from either the coil 24 or base 26. As illustrated in FIG. 1, some of the light rays will be directed toward the lens 62, while others will be directed toward the reflection surface 60 and in turn redirected back toward the lens 62. It will be appreciated that the transversely mounted envelope 12, in effect, provides a dual light source using a single envelope and coil by the transverse mounting of the envelope 12 in a way that keeps its ends 14, 16 exposed and unobstructed. Such leads to beneficial high total light output of the subject light source.

Figure 3:
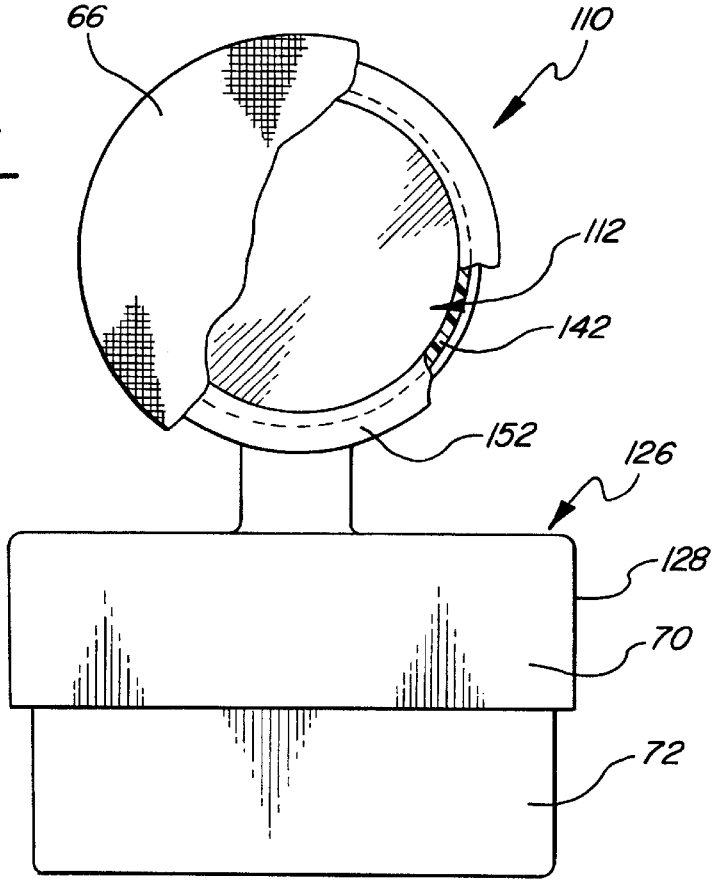
FIG. 3 is a schematic fragmentary elevation view of a lamp assembly constructed according to a second preferred embodiment of the invention.
Figure 4:
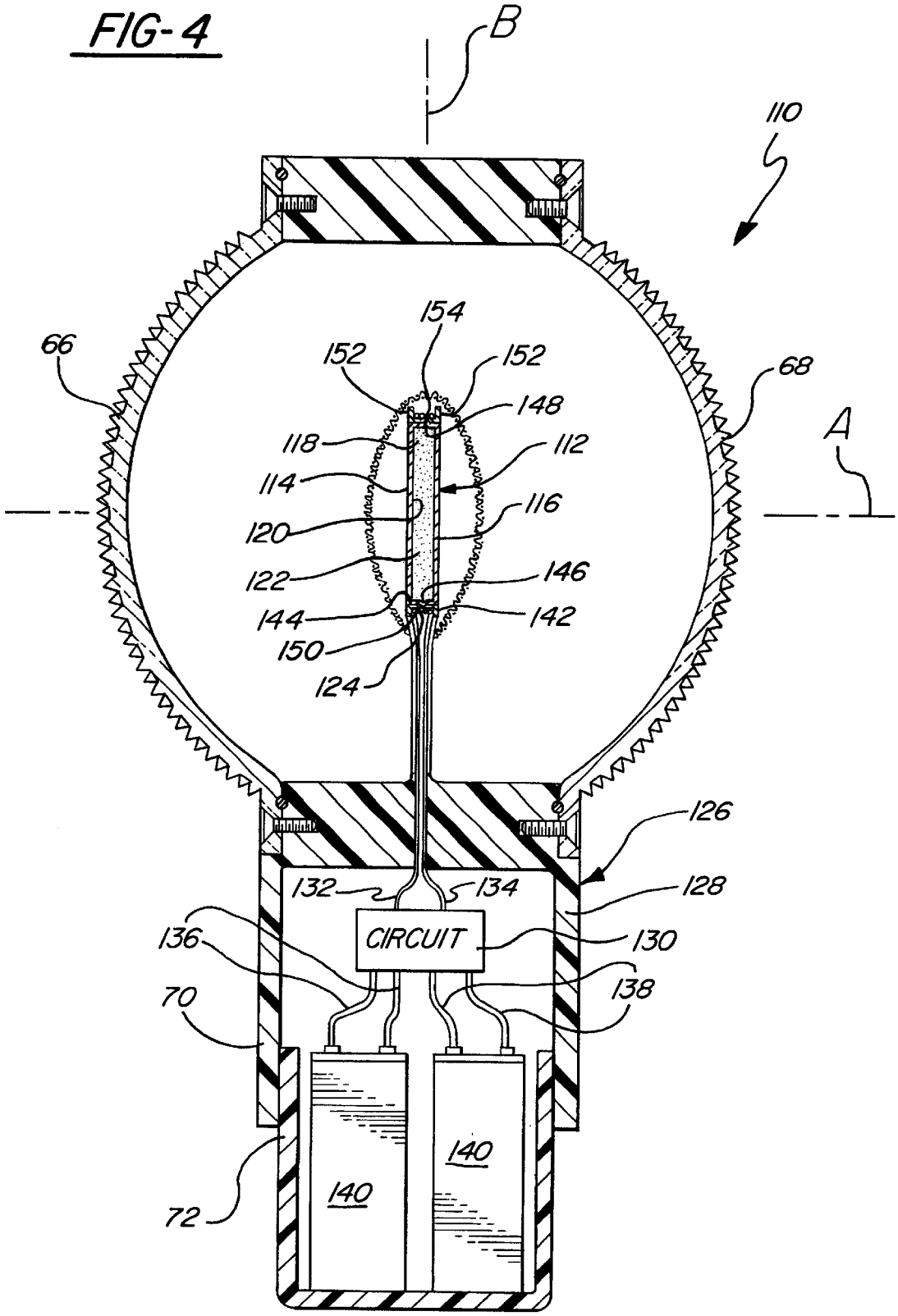
FIG. 4 is an enlarged schematic sectional view taken generally along lines 4—4 of FIG. 3.

FIGS. 3 and 4 illustrate an alternative embodiment of the invention, wherein like numerals are used to indicate like parts, but are offset by 100. The assembly 110 includes a similar light-transmissive envelope 112 having axially opposite ends 114, 116 separated by a midsection 118 and enclosing a space 120 therein for containing an ionizable gas 122. An induction coil 124 is similarly disposed about the midsection 118 and is operative to energize the gas 122 to discharge illumination.

The assembly 110 includes a base 126 having a main body portion 128 in which a circuit 130 and power supply 140 are housed and coupled by leads 132, 134, 136, 138 in similar fashion. The base 126 includes a mounting collar 142 having an opening 144 therein in which the envelope 112 is disposed. Similar locking projections and grooves 146, 150 are provided to lock the envelope 112 within the collar 142. End flanges 152 are provided on the outer diameter surface 154 of the collar 142 to provide a spool and about which the induction coil 124 is wrapped.

The light assembly 110 of the second embodiment is preferably in the form of a double-sided beacon flasher, or the like having a pair of axially opposed lenses 66, 68 through which light is to be directed in axially opposite directions through each of the lenses 66, 68. As shown best in FIG. 4, the opposite ends 114, 116 of the envelope 112 are disposed adjacent each of the corresponding lenses 66, 68, such that light emitting from each end 114, 116 is transmitted directly through each lens 66, 68.

In such a double lens application, the envelope 112 may have a generally, flat disc shape as shown, with the ends 114, 116 being substantially flat and parallel and separated by the intervening midsection 118 which may be cylindrical in shape in order to provide maximum surface area to the ends 114, 116 in a compact envelope configuration that will fit in the space between the lenses 66, 68. As shown best in FIG. 4, the lenses 66, 68 are disposed along the same axis A as that of the envelope 112 in transverse relation to the axis B of the base.

In a beacon-type flasher application, the power supply 140 is preferably in the form of a battery or batteries housed within the main body portion 128 which may comprise separable upper and lower housing portions 70, 72 for gaining access to the interior of the main body portion 128.

The operation of the second embodiment of the assembly 110 is like that of the first embodiment, except that the light emitted from the envelope 112 is directed through the opposed lenses 66, 68.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. An electrodeless gas discharge lamp assembly comprising:

a light-transmissive envelope having opposite ends and a midsection between said ends sealing therein an ionizable gas;

an induction coil disposed about said midsection of said envelope and having an axis extending therethrough, said coil being operative to excite said gas to discharge illumination; and a lamp base mounting said coil and said envelope transversely on said base with said opposite ends exposed, wherein said coil and envelope are oriented on said base such that light originating at said midsection and emanating from said envelope along said axis is transmitted out both ends of said envelope unobstructed by said coil and said base.

2. The assembly of claim 1 wherein said ends of said envelope are axially opposed along said axis.

3. The assembly of claim 1 including a housing having a generally concave reflective surface disposed about an axis of said housing, said base being mounted with said housing such that said envelope is disposed transversely to said axis of said housing.

4. The assembly of claim 1 including an RF shield disposed about said envelope and coil.

5. The assembly of claim 1 including an induction shield disposed about said envelope and said coil.

6. An electrodeless gas discharge lamp assembly comprising:

a light-transmissive envelope having opposite ends and a midsection between said ends sealing therein an ionizable gas, said ends of said envelope being axially opposed along a first axis;

an induction coil disposed about said midsection of said envelope operative to excite said gas to discharge illumination; and a lamp base mounting said coil and said envelope transversely on said base with said opposite ends exposed such that light emanating from said envelope is transmitted out both ends of said envelope substantially unobstructed by said coil and said bases, wherein said base extends along a second axis generally perpendicular to said first axis of said envelope.

7. An electrodeless gas discharge lamp assembly comprising:

a light-transmissive envelope having opposite ends and a midsection between said ends sealing therein an ionizable gas;

an induction coil disposed about said midsection of said envelope operative to excite said gas to discharge illumination; and a lamp base mounting said coil and said envelope transversely on said base with said opposite ends exposed such that light emanating from said envelope is transmitted out both ends of said envelope substantially unobstructed by said coil and said base, wherein said base includes a mounting collar extending about said midsection of said envelope and supporting said envelope and said coil in operative relation to one another.

8. The assembly of claim 7 wherein said mounting collar includes an outer annular channel having opposed side flanges, said induction coil being wound about said mounting collar within said channel and confined between said end flanges.

9. The assembly of claim 8 wherein said ends of said envelope extend axially beyond said mounting collar.

10. The assembly of claim 7 wherein said envelope is mechanically interlocked with said mounting collar.

11. The assembly of claim 10 wherein said mounting collar includes an inner peripheral recess, and said envelope includes an outer peripheral projection disposed within said recess and confined axially thereby to effect said mechanical interlock.

12. An electrodeless gas discharge lamp assembly comprising:

a light-transmissive envelope having opposite ends and a midsection between said ends sealing therein an ionizable gas;

an induction coil disposed about said midsection of said envelope operative to excite said gas to discharge illumination;

a lamp base mounting said coil and said envelope transversely on said base with said opposite ends exposed such that light emanating from said envelope is transmitted out both ends of said envelope substantially unobstructed by said coil and said base; and a pair of light-transmissive lenses supported in axially opposed relation adjacent said opposite ends of said envelope.

13. An electrodeless gas discharge lamp assembly comprising:

a light-transmissive envelope having opposite ends and a midsection between said ends and sealing therein an ionizable gas;

an induction coil disposed about said midsection in substantially unobstructing relation to said ends of said envelope and operative to excite said gas to discharge illumination; and a lamp base having a main body portion with a first axis and a mounting collar portion projecting from said main body portion and having an opening therein disposed about a second axis transverse to said first axis, said envelope being mounted in said opening of said collar in transverse relation to said main body portion with said ends of said envelope exposed and substantially unobstructed by said base such that light emanating from said envelope is transmitted through both ends of said envelope substantially unobstructed by said coil and said base.

14. An electrodeless gas discharge lamp assembly comprising: a lamp housing including a pair of axially opposed lenses; and a light module disposed between said lenses including a light-transmissive envelope having axially opposed ends adjacent said lenses and a midsection between said ends, and sealing therein an ionizable gas inductively excitable to discharge illumination, an induction coil disposed about said midsection of said envelope, and a base mounting said envelope and said coil on said lamp housing with said ends of said envelope exposed such that light emanating from said envelope is transmitted out both of said ends of said envelope substantially unencumbered by said coil and said base for transmission through said lenses of said housing.

15. The assembly of claim 14 wherein said envelope has a generally flat disc-shaped configuration with said ends being generally planar and said midsection having an annular shape.

16. An electrodeless gas discharge lamp assembly comprising:

a lamp housing;

a concave reflective surface located within said housing and being disposed about a first axis; and a light module mounted on said housing including:

a light-transmissive envelope having axially opposite ends disposed transverse to said first axis and a midsection between said ends and sealing therein an ionizable gas inductively excitable to discharge illumination, an induction coil having a second axis and being disposed about said midsection of said envelope with said ends being exposed to thereby permit light to exit said envelope at said ends without obstruction by said coil, and a base mounting said envelope and said coil within said housing, said base being oriented such that said second axis is transverse to said first axis, whereby light originating at said midsection and emanating from said envelope along said second axis is transmitted out both ends of said envelope unobstructed by said coil and said base.

17. A method of making an electrodeless gas discharge lamp assembly comprising:

preparing a light transmissive envelope having axially opposite ends and a midsection between the ends and sealing therein an ionizable gas excitable to discharge illumination;

disposing an induction coil about the midsection of the envelope leaving the ends of the envelope exposed such that an axis of said coil extends out of both said ends; and mounting the envelope and coil on a base with the envelope being transversely oriented with respect to the base so that that light originating at the midsection and emanating from the envelope along the axis is transmitted out both ends of the envelope unobstructed by the coil and base.

18. The method of claim 17 including forming the base with an annular mounting collar and mounting the envelope within the collar so that the collar extends about the midsection of the envelope and wrapping the coil about the collar.

19. The method of claim 18 including forming a recess in an interior surface of the collar and forming a radial locking projection on the envelope, and locating the projection within the recess upon insertion of the envelope into the collar.

20. The method of claim 17 including mounting the base on a lamp housing having a generally concave reflective surface disposed about an axis with the envelope oriented transversely to the axis of the housing and both ends of the envelope exposed.

21. The method of claim 17 including mounting the base on a lamp housing having a pair of axially opposed lenses with the ends of the envelope exposed and adjacent the lenses for transmitting light in axially opposite directions through the lenses.

* * * * *